United States Patent [19]

Jewell, deceased et al.

[11] Patent Number: 4,843,649

[45] Date of Patent: Jul. 4, 1989

[54] SHELL HOLDER AND DISPENSER

[76] Inventors: Emmett J. Jewell, deceased, late of St. Paul, Minn.; by Kathleen R. Jewell, representative, 1730 Goodrich Ave., St. Paul, Minn. 55105; Timothy J. Van Kampen, 1551 Birmingham St., St. Paul, Minn. 55106

[21] Appl. No.: 161,498

[22] Filed: Feb. 29, 1988

[51] Int. Cl.[4] ..... F42B 39/02; A41D 3/02

[52] U.S. Cl. ..... 2/94; 224/239

[58] Field of Search ..... 2/94, 95; 224/223, 224, 224/239, 269

[56] References Cited

U.S. PATENT DOCUMENTS

| | | | |
|---|---|---|---|
| 287,804 | 11/1883 | Collins . | |
| 466,298 | 12/1891 | Dean | 2/94 X |
| 516,967 | 3/1894 | Dudley | 2/94 X |
| 523,177 | 7/1894 | Rice . | |
| 695,176 | 3/1902 | Rumsey . | |
| 775,149 | 11/1904 | Righton . | |
| 1,212,513 | 1/1917 | Langerman | 2/94 |
| 3,042,257 | 7/1962 | Dailey . | |
| 4,082,209 | 4/1978 | Sanders . | |
| 4,199,078 | 4/1980 | Ramirez . | |
| 4,502,612 | 3/1985 | Morrison | 224/239 X |

*Primary Examiner*—Werner H. Schroeder
*Assistant Examiner*—Sara M. Current
*Attorney, Agent, or Firm*—Burd, Bartz & Gutenkauf

[57] ABSTRACT

A shotgun shell holder and dispenser mounted on a hunting vest has a plurality of upright loops for accommodating shotgun shells in end-to-end relation. A dispenser comprises a tube is located in the bottom of each loop. Flexible retaining structure on the bottom of each tube releasably holds the shells in the tubes and loops. A releasable fastener secures each tube to the structure forming the loops so that the tubes can be removed and replaced with tubes to accommodate different caliber cartridges and gauged shells.

37 Claims, 3 Drawing Sheets

SHELL HOLDER AND DISPENSER

FIELD OF INVENTION

The invention is related to an object holding and dispensing apparatus for accommodating a plurality of objects in end-to-end relation for individual dispensing of the objects as required. Particularly, the apparatus is a shotgun shell and cartridge holder and dispenser usable with a hunting jacket or vest.

BACKGROUND OF INVENTION

Various structures have been used to hold and dispense ammunition for use in firearms. Examples of cartridge and shell accommodating devices are disclosed by Collins in U.S. Pat. No. 287,804; Rice in U.S. Pat. No. 523,177; and Rumsey in U.S. Pat. No. 695,176; and Righton in U.S. Pat. No. 775,149. These patents are representative of the state of the art in the 1883–1904 era. The shell holding devices have a plurality of sleeves with upright generally cylindrical passages for accommodating shells and cartridges. Harness, suspender, and belt structures are used to carry the sleeves adjacent the body of a person. Collins utilizes releasable latches for holding the cartridges in the sleeves. The releasable latches include pivoted arms that can be manually moved to a release position to allow the cartridges to move to a down position where they can be removed from the sleeves.

The devices for holding ammunition in a hunting jacket or vest comprised fabric loops that retain the individual cartridges. A dispensing unit is not used with the loops so that each cartridge must be pulled from the loop for use in the firearm. One difficulty is that the loops only hold a single shell and that a limited number of shells can be carried by the jacket or vest. The loops have a specific size for accommodating one type of shell or cartridge. Other types of ammunition such as rifle cartridges, bullets, and different gauged shotgun shells cannot be accommodated by the loops. Applicant's shell holder and dispenser has overcome the disadvantages of the prior shell holding structures for use with hunting jackets and vests.

SUMMARY OF INVENTION

The invention is directed to a dispensing apparatus for holding a plurality of objects in end-to-end relation for individually and manually removing the objects as required. More particularly, the apparatus is a shotgun shell and like ammunition holder and dispenser that is usable with a hunting vest and jacket that is carried by a person in the field. The holder accommodates shells and positions the shells so they can be selectively removed for use in a firearm.

According to the invention, a hunting vest having front panels is used to support a shell holder and dispenser apparatus. A separate shell holder and dispenser apparatus can be secured to each front panel of the hunting vest. The shell holder and dispenser apparatus has a back sheet member that is attached to a panel of the hunting vest. A second sheet member having a plurality of loops that form loop passages for holding the shells is attached to the back member. The number of loops can vary. As shown in FIGS. 1 and 2, the holder has three loops. The loop passages have open top and bottom openings. A flap secured to the back member closes the top openings of the passages of the loops. The flap can be moved to a position to allow shells to be loaded into the loop passages. A shell dispenser is mounted in the lower portion of each loop passage of each loop to retain the shells in the loop passage and allow the shells to be selectively removed from the dispenser. The dispenser comprises a tubular member that is releasably mounted on the back member. The tubular member has a tube passage aligned with the loop passage for accommodating shells. The tubular member has a lower end with a shell holder, such as one or more flexible downwardly extended fingers or a lip, that retain the shells in the tube passage. Each finger has an inwardly directed stop member that engages the end of the lower shell to retain the shell in the tube passage. The finger is manually flexed in an outward direction to selectively remove the shell. In one form of the invention, a clip hook joined the tube is used to releasably mount the tube in the loop passage. The clip hook allows the tube to be removed from the back member so that the vest can be cleaned without damaging the dispenser. Tubes of different sizes may be used with the same vest to accommodate different types of shells such as different gauged shotgun shells, rifle cartridges, bullets, and the like.

The holder and dispenser apparatus is herein described for use with a hunting vest to store shotgun shells. The holder and dispenser is useable to accommodate other types of objects that are separately dispensed. These and other advantages and objects of the holder and dispenser apparatus of the invention are set forth in the following description thereof.

DESCRIPTION OF PREFERRED EMBODIMENTS

Figure 1:
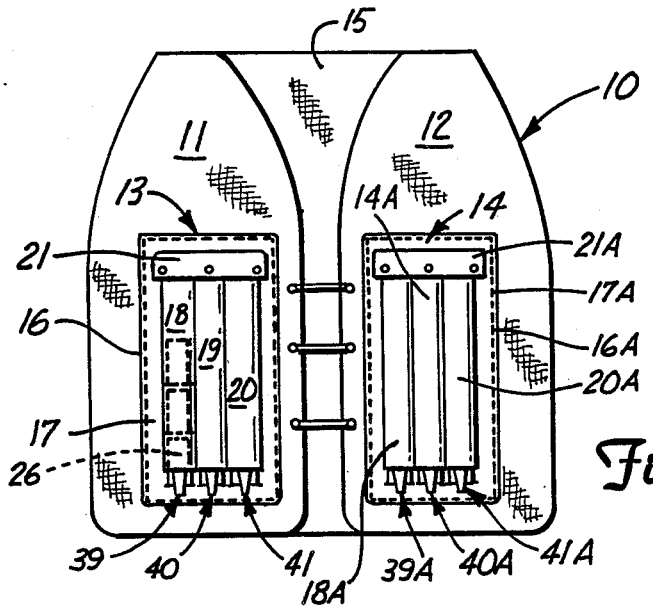
FIG. 1 is a front view of a hunting vest carrying two shell holder and dispenser apparatus of the invention.

Referring to FIG. 1, there is shown a conventional hunting vest indicated generally at 10 having front panels 11 and 12 joined to a back 15. Vest 10 is adapted to be worn by a person, such as a small game hunter in the field. Other types of garments can be used to support the holder and dispenser apparatus of the invention. The garment worn by the person can be a shirt, jacket, coat, or life vest when hunting in a water environment. A pair of shell holder and dispenser apparatuses indicated generally at 13 and 14 are secured to front panels 11 and 12 respectively. The following description is directed to shell holder and dispenser apparatus 13. The shell holder and dispenser apparatus 14 is identical with apparatus 13 with like parts identified by the same reference number having suffix A.

Figure 2:
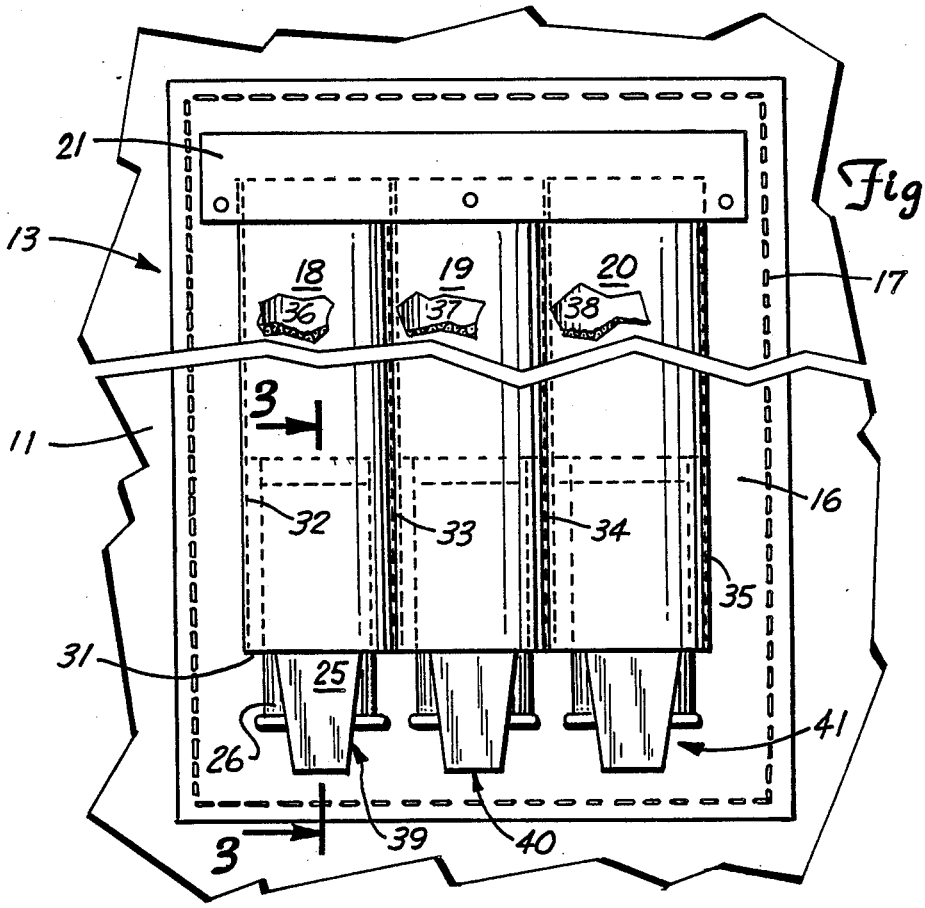
FIG. 2 is an enlarged foreshortened front plan view of the shell holder and dispenser apparatus of FIG. 1.

Referring to FIG. 2, a shell holder and dispenser apparatus 13 has a generally rectangular base or back sheet member 16 that is attached to panel 11 with stitches 17. The stitches 17 extend around the outer peripheral edge of base 16 to permanently affix base 16 to panel 11. Other types of connectors such as rivets, buttons, snaps, and releasable hook and loop fasteners can be used to attach the base to panel 11. Base 16 is preferably a fabric, such as denim, corduroy, and the like. Other types of materials, including coated fabrics, rubber, plastics and synthetics, such as Nylon, can be used for the base 16.

A second sheet member formed into upright loops 18, 19, and 20 is attached to the base 16 with a plurality of vertical stitches 32, 33, 34, and 35. The number of loops can vary. The holder, as shown in FIGS. 1 and 2 has three loops 18, 19 and 20. The second sheet member can be a fabric, coated fabric, rubber, plastic and synthetics, such as Nylon or the like. The stitches 32–35 are vertically orientated and parallel to each other to attach the second sheet member to the front of base 16 and form upright loops 18, 19, and 20. The loops 18, 19 and 20 have vertical loop passages or spaces 36, 37, and 38 to accommodate a plurality of shells in an end-to-end vertical relation. Each loop passage 36, 37, and 38 has an open top end and an open bottom end. The passages 36, 37, and 38 each have a transverse size and longitudinal length to accommodate shells, such as 12 gauge shotgun shells. The shells are loaded into the loop passages 36, 37, and 38 through the open top openings. Preferably, a plurality of shells are placed in each loop passage. The top openings of the loop passages 36, 37, and 38 is closed with a generally horizontal flap or cover 21. Releasable fasteners, such as snaps, buttons, and hook and loop structures can be used to retain the flap 21 in a closed position that overlaps the top of loops 18, 19, and 20. The cover 21 can be folded up to allow the shells to be loaded into passages 36, 37, and 38.

Figure 5:
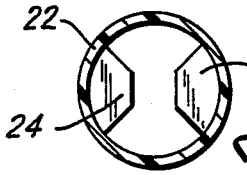
FIG. 5 is a sectional view taken along line 5—5 of FIG. 4.
Figure 4:
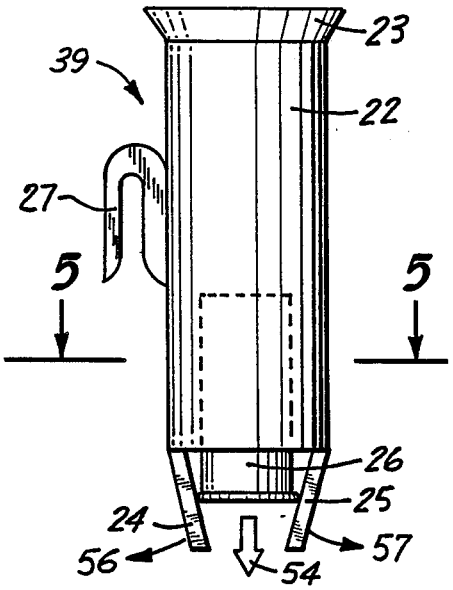
FIG. 4 is a side elevation view of the shell dispenser removed from the holder.
Figure 3:
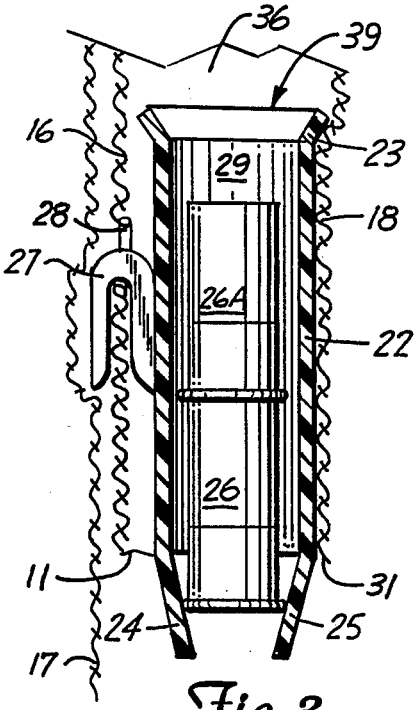
FIG. 3 is an enlarged sectional view taken along the line 3—3 of FIG. 2.

As shown in FIG. 2, shell dispensers indicated generally at 39, 40, and 41 are located in the lower ends of loops 18, 19, and 20 respectively. The dispensers 39, 40, and 41 have lower portions that extend downwardly below the lower edge 31 of loops 18, 19, and 20 to facilitate the gripping of the lower shell and extracting the shell from the dispenser. The dispensers 39, 40, and 41 are identical in structure. The following description is directed to dispenser 39 as shown in FIGS. 3, 4, and 5.

Dispenser 39 has an elongated tube or tubular body 22 having an upright generally cylindrical tube passage 29. Passage 29 has a diameter to allow for the free movement of shells 26 and 26A in the downward direction. The upper end of tube 22 has an outwardly directed annular flange or lip 23 which serves to guide the shells from loop passage 26 into tube passage 29. A pair of downwardly and inwardly converging flexible fingers 24 and 25 are integral with the bottom of tube 22. Fingers 24 and 25 extend downwardly below the bottom edge 31 of the loops 18. Fingers 24 and 25 project downwardly toward each other. The transfer distance between the fingers 24 and 25 is less than the diameter of shell 26 so that the fingers 24 and 25 function as stop to retain the shells in the tube passage 29, as shown in FIG. 3. Tube 22, flange 23, fingers 24 and 25 and hook 27 are made of plastic, such as polyethylene. The tube 22, flange 23 and fingers 24 and 25 are preferably a one-piece plastic member. The plastic material of the fingers 24 and 25 is flexible so each finger can be removed from the dispenser. The material of the fingers 24 and 25 has memory so that fingers 24 and 25 return to their converged positions as shown in FIGS. 4 and 5.

A downwardly open clip or hook 27 is secured to the mid-portion of tube 22. Hook 27 can be joined to the upper end of tube 22. As shown in FIG. 3, hook 27 extends through an opening or slit 28 in base 16 to retain the dispenser in assembled relation with the holder. The dispenser 39 can be removed from base 16 by moving the hook upwardly through the slit 28. Dispenser 39 can then be moved downwardly from loop 18. The dispenser 39 can be replaced with a dispenser having different diameters for use with different types of shotgun shells, bullets and rifle cartridges. All of the dispensers 39, 40, and 41 can be removed from the loops 18, 19, and 20 so that vest 10 can be cleaned or repaired without the dispensers.

Figure 6:
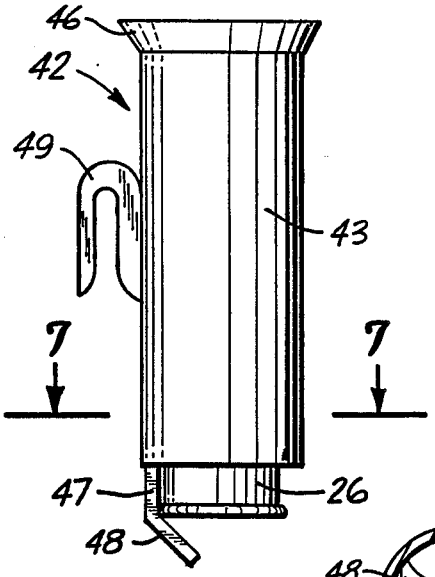
FIG. 6 is a side elevation view of a modified shell dispenser.
Figure 8:
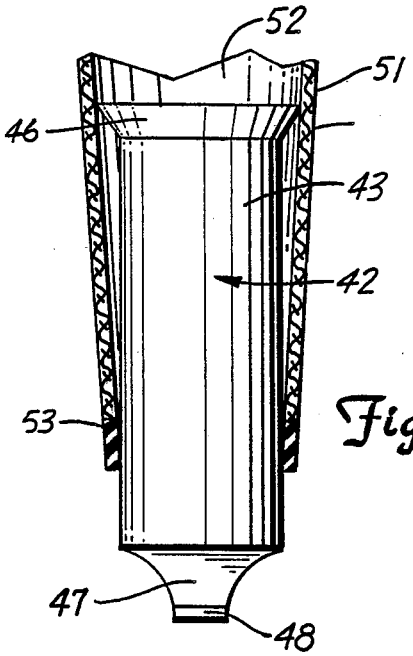
FIG. 8 is a front view of the shell dispenser of FIG. 6 located within a holder.
Figure 7:
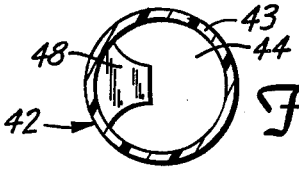
FIG. 7 is a sectional view taken along line 7—7 of FIG. 6.

Referring to FIGS. 6, 7, and 8, there is shown a modification of the dispenser indicated generally at 42 usable with loops 18, 19, and 20. Dispenser 42 has a elongated tube or tubular body 43 having a longitudinal tube passage 44 for accommodating one or more shells 26. The upper end of the tube 43 has an outwardly directed annular flange or lip 46 which serves to guide the shells into tube passage 44. A flexible shell retaining finger 47 is integral with the bottom of tube 43. Finger 47, shown in FIGS. 6 and 8, extends in a downward direction and terminates in an inwardly and downwardly directed finger tip 48. Finger tip 48 is engageable with shell 26 to retain the shell within the passage of tube 43. Finger 47 is made of flexible plastic material which will allow finger tip 48 to be biased and moved away from the end of the shell 46 whereby shell 46 can be retracted from tube 43. Once shell 26 is removed from the tube 43, finger 47 will move back to its original position as shown in FIG. 6 due to the memory of the plastic material and hold the subsequent shell from moving from tube 43.

The mid-section of tube 43 is attached to a downwardly open clip or hook 49. Hook 49 can be joined to the upper end of tube 43. Hook 49 is adapted to fit through a slit, such as slit 28 shown in FIG. 3 to releasably mount the tube 42 on member 16.

Referring to FIG. 8, dispenser 42 is located within a tubular member or loop 51 having an upright passage 52 for accommodating one or more shells. The bottom of the loop 51 is attached to an elastic band or ring 53. The ring 53 fits tight around the bottom portion of tube 43 to prevent tube 43 from moving out the bottom of loop 51. Hook 49 on the tube 43 can be eliminated as the elastic band 51 can have sufficient force to retain tube 43 in assembled relation with loop 51. Preferably, tube 43 is attached to a hook operable to releasably mount the dispenser on a support such as back member 16.

In use, the holder and dispenser apparatuses 13 and 14 are mounted on the front panels 11 and 12 of the vest 10 with stitches, adhesive, or releasable fasteners. The loops 18, 19, and 20, 18A, 19A, and 20A are oriented in an upward or vertical direction. The flap 21 is located adjacent the top of the loops 18, 19 and 20 to normally close the openings into the loop passages 36, 37 and 38. The dispensers 39, 40, and 41 are positioned in the lower portions of the loop passages 36, 37, and 38 as seen in FIG. 2. Base member 16 is provided with a plurality of slits 28 to accommodate hooks 27 on each of the tubes 22 of the dispensers. The slits 28 are located adjacent the lower ends of loops 18, 19, and 20 so that flexible fingers 24 and 25 project downwardly from the bottom edge 31 of the loops 18, 19, and 20.

Apparatus 13 is loaded with shells, such as shotgun shells 26. The rim end of the shells is located in a downward direction and inserted through the top openings of loop passages 36, 37, and 38. The shells can be located in passages 36, 37, and 38 with the rims in the upward direction. The lower shell engages the flexible fingers 24 and 25, as seen in FIGS. 2, 3, and 4 to retain the shells in tube passage 29. The lower or rim portion of the shell extends below tube 22 so it can be gripped with a person's fingers. The person then pulls down on shell 26 in the direction of arrow 54 as shown in FIG. 4. This flexes fingers 24 and 25 in an opposite outward direction as shown by the arrows 56 and 57. Shell 26 is then retracted from the tube 22. Shell 26A immediately above shell 26 then falls down into engagement with fingers 24 and 25. Fingers 24 and 25 spring back to their inwardly converging positions shown in FIGS. 3 and 4 so that the subsequent shell 26A is retained in a ready position to be extracted from tube 22. All of the shells in apparatus 13 and 14 can be selectively and individually removed as needed.

The dispensers 39, 40, and 41 can be removed from the loops 18, 19, and 20 by unhooking the tubes from back 16. Dispensers having different diameters can be inserted into the tube passage 36 to accommodate different caliber or gauged ammunition or different types of ammunition. The tubes can also be removed from the loops 18, 19, and 20 so that the vest or jacket can be cleaned and repaired.

Figure 9:
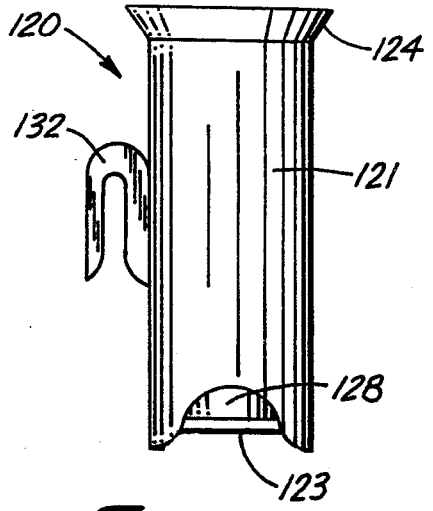
FIG. 9 is a side elevational view of a second modified shell dispenser.
Figure 10:
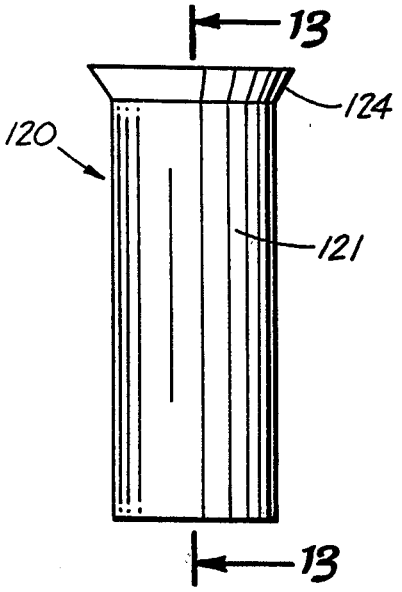
FIG. 10 is a front elevational view of the shell dispenser of FIG. 9.
Figure 11:
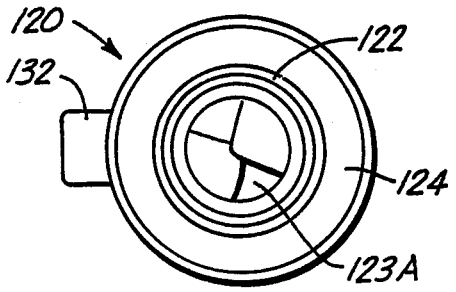
FIG. 11 is a top view of FIG. 9.
Figure 12:
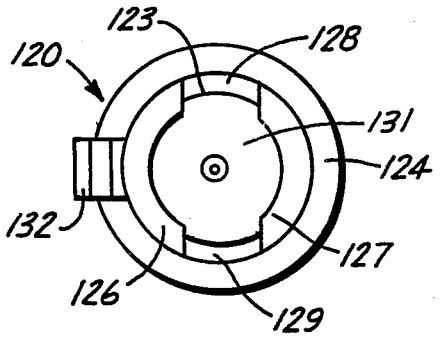
FIG. 12 is a bottom view of FIG. 9.
Figure 13:
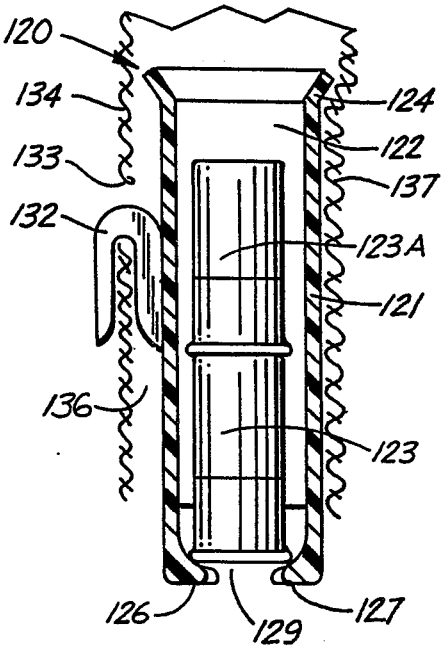
FIG. 13 is a sectional view taken along the line 13—13 of FIG. 10 with the shell dispenser located in a holder.

Referring to FIGS. 9 to 13, there is shown a second modification of the dispenser indicated generally at 120 usable with loops 18, 19, and 20 for accommodating a plurality of shotgun shells and like objects. Dispenser 120 has an elongated tube or tubular member 121 providing an elongated upright tubular passage 122 for accommodating one or more shells 123, 123A. The upper end of tube 121 has a continuous outwardly directed flange or lip 124 which facilitates the movement of the shells into passage 122. The lower end of tube 121 has shell retaining structure comprising inwardly directed rims or lips 126 and 127 adapted to engage the rim of lower shell 123 to hold shell in passage 122 of tube 121. As shown in FIGS. 9 and 13, the rim of shell 123 is protected by the side walls of the lower end of the tube. The lower end of the rim of the shell is located within tube passage 122 thereby protecting the rim and firing cap of the shell from inadvertant damage. Lips 126 and 127 function as stops that hold the shells in passage 122 of tube 121. Upwardly directed recesses 128 and 129 are located in opposite sides of the lower end of tube 121 to facilitate the gripping of shell 123 with the fingers of a user. Recesses 128 and 129 are open to the bottom opening 131. The corners and edges of the lips 126 and 127 are rounded to minimize snagging with objects in the field and sharp edges that can be engaged by the fingers of the users. Lips 126 and 127 each have a generally arcuate configuration as shown in FIG. 12 and are located on opposite portions of opening 131. The lower end of tube 121 can be provided with other types of shell retaining structure, such as a single lip, rib or projection which extends into passage 122 a distance to normally engage the rim of shell 123. Alternatively, the lower end wall of tube can taper inwardly to form a stop for lower shell 123. The tapered end can be provided with one or more longitudinal slits to allow the end to expand during extraction of the shell 123 from tube passage 122.

The mid-section of tube 121 is secured to a downwardly directed clip or hook 132. Hook 132 can be joined to the upper end of tube 121. Hook 132 is adapted to fit through a slit 133 in a support sheet member 134. Hook 132 maintains the dispenser 120 in a upright pocket 136 formed by a loop 137. Loop 137 is part of the shell holder 13 shown in FIGS. 1 and 2.

Dispenser 120 is loaded with shells, such as shotgun shells 123 and 123A. The rim end of each shell is located in a downward direction. The shells can be placed in the tubes 121 with rims in the upward direction. The shells are loaded through the top outwardly directed flange 124 of tube 121 into passage 122. The lower shell 123 engages the lips 126 and 127 to retain the shells in passage 122. The tube 120 can be provided with a single lip, such as lip 126 or a tapered end wall which normally engages the rim end of the lower shell 123 to hold the shells in the passage 122 so as to protect shell 123 while allowing the shell to be removed from the dispenser.

The person utilizes the thumb and first finger and grips opposite portions of shell 123 via recesses 128 and 129. Downward pull on shell 123 will slightly expand the lower end of tube 121 allowing shell 123 to be extracted from passage 122. Shell 123A immediately above shell 123 falls downwardly into engagement with the lips 126 and 127 as tube 121 returns to its original position. Tube 121, top flange 124, and the bottom lips 126 and 127 are made of plastic, such as polyethelane. Preferably, the plastic has memory such that when it is flexed or expanded, it will return to its original position when the force of the plastic material has been released. Tube 122, flange 124, lips 126 and 127, and hook 132 can be made of one-piece plastic member.

While there has been shown and described several embodiments of the shell holder and dispenser apparatus of the invention, it is understood that changes in the shape, contour, structure, materials, and arrangement of structure may be made by those skilled in the art without departing from the invention. The holder and dispenser apparatus can be used with other objects. The invention is defined in the following claims.

The embodiments of the invention in which an exclusive property or privilege is claimed are defined as follows:

1. An apparatus for holding firearm ammunition comprising:

holding means having a plurality of elongated loops normally extended in an upright direction, each of said loops having a loop passage for accommodating firearm ammunition, ammunition dispensing means located in each loop passage operable to selectively allow ammunition to be removed from the dispensing means, each dispensing means comprising a tube having a tube passage for accommodating said ammunition, said tube passage being aligned with a loop passage, and retaining means joined to the tube to hold the ammunition in the dispensing means, said retaining means being manually movable to allow the ammunition to be removed from the tube passage, and means including a hook connected to each tube to releasably mount each tube on the holding means, said hook being engageable with the holding means to releasably mount each tube on the holding means whereby each tube can be removed from the holding means.

2. The apparatus of claim 1 wherein: said holding means includes a first sheet member, and a second sheet member connected to the first sheet member, said first and second sheet members providing said plurality of elongated loops, said tubes of the dispensing means being located between the first and second sheet members in the passages of the loops.

3. The apparatus of claim 2 wherein: each tube has an inlet end and an outlet end, said retaining means including finger means being joined to the outlet end of the tube and extended downwardly below the lower end of said loop passages.

4. The apparatus of claim 2 wherein: each tube has an inlet end and an outlet end, said retaining means including finger means being joined to the outlet end and an outwardly directed flange on the inlet end of the tube to guide ammunition into the tube passage.

5. The apparatus of claim 1 wherein: said flexible retaining means include finger means comprising a plurality of inwardly directed fingers engageable with the ammunition to retain the ammunition in the dispensing means, said fingers being spaced from each other so that the ammunition engageable with the finger means can be manually gripped by a person to allow the ammunition to be pulled from the tube passage.

6. The apparatus of claim 1 wherein: said retaining means comprises a single flexible finger having a stop portion engageable with ammunition to retain the ammunition in the dispensing means.

7. The apparatus of claim 1 wherein: said holding means includes a first sheet member and a second sheet member connected to the first sheet member, said first and second sheet members having said plurality of elongated loops, one of said sheet members having slits open to each of the loop passages, said hook on each tube being located through a slit to releasably mount the tube on the holding means.

8. The apparatus of claim 1 wherein: said elongated loops have upper ends with openings in communication with the loop passage whereby ammunition can be loaded into the loop passage through the said openings, and flap means mounted on the holding means to close said openings, said flap means being movable to a position to allow said ammunition to be loaded into said loop passages.

9. An apparatus for holding firearm ammunition comprising:

holding means having a plurality of elongated loops normally extended in an upright direction, each of said loops having a loop passage for accommodating firearm ammunition, ammunition dispensing means located in each loop passage operable to selectively allow ammunition to be removed from the dispensing means, each dispensing means comprising a tube having a tube passage for accommodating said ammunition, said tube passage being aligned with a loop passage, and retaining means joined to the tube to hold the ammunition in the dispensing means, and allow the ammunition to be manually removed from the tube passage, said retaining means includes at least one inwardly directed lip at the lower end of the tube to hold the ammunition in the tube passage, said lower end of the tube having recess means which permit a person to grip the ammunition and extract the ammunition from the tube, and means to releasably mount each tube on the holding means whereby each tube can be removed from the holding means.

10. The apparatus of claim 9 wherein: said means to releasably mount each tube on the holding means includes hook means connected to each tube, said hook means being engageable with the holding means to releasable mount each tube on the holding means whereby each tube can be removed from the holding means.

11. A hunting garment and holder and dispenser for firearm ammunition comprising: a hunting garment having a front panel, ammunition holding means having a plurality of elongated loops normally extended in an upright direction secured to said front panel, each of said loops having a loop passage for accommodating firearm ammunition, each loop passage having an open upper end and an open bottom end, said firearm ammunition being loaded into the loop passage, ammunition dispensing means located in each loop passage adjacent the lower end thereof operable to selectively allow ammunition to be removed from the dispensing means, each dispensing means including a tube having a tube passage for accommodating said ammunition, said tube passage being aligned with a loop passage, and flexible finger means joined to the tube to retain ammunition in te dispensing means, said finger means projecting downwardly below the lower open end of said tube passage and being manually movable to allow the ammunition to be removed from the tube passage, and means including a hook connected to each tube to releasably mount each tube on the holding means, said hook being engagable with the holding means to releasably mount the tube on the holding means whereby each tube can be removed from the holding means.

12. The apparatus of claim 11 wherein: said holding means includes a first sheet member, and a second sheet member connected to the first sheet member, said first and second sheet members providing said plurality of elongated loops, said tubes of the dispensing means being located between the first and second sheet members in the passages of the loops.

13. The apparatus of claim 12 wherein: each tube has an inlet end and an outlet end, said finger means being joined to the outlet end of the tube and extended downwardly below the lower end of said loop passages.

14. The apparatus of claim 13 including: an outwardly directed flange on the inlet end of the tube to guide ammunition into the tube passage.

15. The apparatus of claim 11 wherein: said flexible finger means comprises a plurality of inwardly directed fingers engageable with the ammunition to retain the ammunition in the dispensing means, said fingers being spaced from each other so that the ammunition engageable with the finger means can be manually gripped by a person to allow the ammunition to be pulled from the tube passage.

16. The apparatus of claim 11 wherein: said flexible finger means comprises a single flexible finger having a stop portion engageable with ammunition to retain the ammunition in the dispensing means.

17. The apparatus of claim 11 wherein: said holding means includes a first sheet member and a second sheet member connected to the first sheet member, said first and second sheet members having said plurality of elongated loops, one of said sheet members having slits open to each of the loop passages, said hook on each tube being located through a slit to releasably mount the tube on the holding means.

18. The apparatus of claim 11 including: flap means mounted on the holding means to close said openings, said flap means being movable to a position to allow said ammunition to be loaded into said loop passages.

19. An apparatus for holding firearm ammunition comprising: holding means having at least one elongated loop normally extended in an upright direction, said loop having a loop passage for accommodating firearm ammunition, ammunition dispensing means located in said loop passage operable to selectively allow ammunition to be removed from the dispensing means, said dispensing means comprising first means having a tubular passage for accommodating said ammunition, said tubular passage being aligned with the loop passage, second means joined to the first means to retain the ammunition in the dispensing means and allow the ammunition to be manually removed from the tubular passage of the first means, and third means to releasably mount the dispensing means on the holding means whereby the dispensing means can be removed from the holding means, said third means includes a hook connected to the first means, said hook being engagable with the holding means to releasably mount the first means on the holding means whereby the first means can be removed from the holding means.

20. The apparatus of claim 19 wherein: said holding means includes a first sheet member, and a second sheet member connected to the first sheet member, said first and second sheet members providing said elongated loop, said tube of the dispensing means being located between the first and second sheet members in the passage of the loop.

21. The apparatus of claim 19 wherein: said tube has an inlet end and an outlet end, said second means comprising finger means being joined to the outlet end of the tube and extended downwardly below the lower end of said loop passage.

22. The apparatus of claim 21 including: an outwardly directed flange on the inlet end of the tube to guide objects into the tube passage.

23. The apparatus of claim 19 wherein: said second means includes flexible finger means comprising a plurality of inwardly directed fingers engageable with the ammunition to retain the ammunition in the dispensing means, said fingers being spaced from each other so that the ammunition engageable with the finger means can be manually gripped by a person to allow the ammunition to be pulled from the tube passage.

24. The apparatus of claim 19 wherein: said second means includes flexible finger means comprising a single flexible finger having a stop portion engageable with ammunition to retain the ammunition in the dispensing means.

25. The apparatus of claim 19 wherein: said holding means includes a first sheet member and a second sheet member connected to the first sheet member, said first and second sheet members having said plurality of elongated loops, one of said sheet members having said plurality of elongated loops, one of said sheet members having slits open to each of the loop passages, said hook on each first means being located through a slit to releasably mount the first means on the holding means.

26. The apparatus of claim 19 wherein: said elongated loop has an upper end with opening in communication with the loop passage through the said opening, and flap means mounted on the holding means to close said opening, said flap means being movable to a position to allow said ammunition to be loaded into said loop passage.

27. An apparatus for holding an object comprising: first means having at least one elongated loop, said loop having a loop passage for accommodating an object, object dispensing means located within said loop passage operable to selectively allow an object to be removed from said dispensing means, said dispensing means comprising a member having a tubular passage aligned with the loop passage for accommodating said object, and flexible means joined to said member to retain the object in the tubular passage, said flexible means being manually movable to allow the object to be removed from the dispensing means, and second means for releasably mounting the member on said first means said second means includes a hook connected to the member, said hook being engageable with the first means to releasably connect the member to the first means whereby the member can be removed from the first means.

28. The apparatus of claim 27 wherein: the first means includes a first sheet member, and a second sheet member connected to the first sheet member, said second sheet member having at least one elongated loop, said loop having said loop passage.

29. The apparatus of claim 27 wherein: the first means includes a first sheet member, and a second sheet member connected to the first sheet member, said second sheet member having a plurality of elongated loops, each of said loops having a loop passage for accommodating objects, and a dispensing means located in each loop passage operable to allow an object to be removed from the dispensing means.

30. The apparatus of claim 27 wherein: said member comprises a tube having a tube passage for accommodating said object, said tube passage being aligned with the loop passage, said flexible means comprising flexible finger means joined to said tube to releasably retain the object in said tube passage, said hook being joined to the tube, said hook being releasably connected to said first means whereby said tube can be removed from the first means.

31. The apparatus of claim 30 wherein: said flexible finger means comprises a plurality of inwardly directed fingers engageable with the object to retain the object in the dispensing means, said fingers being spaced from each other so that the object engageable with the finger means can be manually gripped by a person to allow the object to be pulled from the tube passage.

32. The apparatus of claim 30 wherein: said flexible finger means comprises a single flexible finger having a stop portion engageable with object to retain the object in the dispensing means.

33. The apparatus of claim 27 wherein: said first means includes a first sheet member and a second sheet member connected to the first sheet member, said first and second sheet members having said plurality of elongated loops, one of said sheet members having slits open to eand of the loop passages, said hook on each member being located through a slit to releasably mount the member on the first means.

34. The apparatus of claim 27 wherein: said elongated loop has an upper end with an opening in communication with the loop passage whereby an object can be loaded into the loop passage through the said opening, and flap means mounted on the first means to close said opening, said flap means being movable to a position to allow said object to be loaded into said loop passage.

35. The apparatus of claim 27 wherein: said flexible means comprises at least one inwardly directed lip at the lower end of the tube to releasably retain the object in said tube passage.

36. An apparatus for holding an object comprising: first means having at least one elongated loop, said loop having a loop passage for accommodating an object, object dispensing means located within said loop passage operable to selectively allow an object to be removed from said dispensing means, said dispensing means comprising a tube having a tubular passage aligned with the loop passage for accommodating said object, and flexible means joined to said tube to retain the object in the tubular passage and allow the object to be manually removed from the dispensing means, said flexible means comprising a plurality of inwardly directed lips at the lower end of the tube to releasably retain the object in the tubular passage, said lower end of the tube having upwardly directed recesses providing finger access to the object engaging said lips whereby the object can be manually gripped by a person to allow the object to be pulled from the tube passage and second means for releasably mounting the tube on said first means.

37. The apparatus of claim 36 wherein: said second means to releasably mount each tube on the first means includes hook means connected to each tube, said hook means being engagable with the first means to releasably mount each tube on the first means whereby each tube can be removed from the first means.

* * * * *